US010617583B1

(12) United States Patent
Sayed et al.

(10) Patent No.: US 10,617,583 B1
(45) Date of Patent: Apr. 14, 2020

(54) BED WITH RETRACTABLE SIDE EXTENSION

(71) Applicant: KING SAUD UNIVERSITY, Riyadh (SA)

(72) Inventors: Hany Hassan Aly Sayed, Riyadh (SA); Thamer Ali Albahkali, Riyadh (SA); Mohamed Elsayed Mohamed Bassuni, Riyadh (SA)

(73) Assignee: King Sand University, Riyadh (SA)

( * ) Notice: Subject to any disclaimer, the term of this patent is extended or adjusted under 35 U.S.C. 154(b) by 0 days.

(21) Appl. No.: 16/583,214

(22) Filed: Sep. 25, 2019

(51) Int. Cl.

| | |
|---|---|
| ***A61G 7/05*** | (2006.01) |
| ***A61G 7/012*** | (2006.01) |
| ***A47C 19/04*** | (2006.01) |
| ***A61G 7/002*** | (2006.01) |

(52) U.S. Cl.
CPC ..... *A61G 7/0525* (2013.01); *A61G 7/012* (2013.01); *A47C 19/04* (2013.01); *A61G 7/002* (2013.01)

(58) Field of Classification Search
CPC ..... A47B 23/025; A47C 17/22; A47C 17/32; A47C 19/04; A61G 7/002; A61G 7/05; A61G 7/0507; A61G 7/0508; A61G 7/0519; A61G 7/1025; A61G 7/1034
See application file for complete search history.

(56) References Cited

U.S. PATENT DOCUMENTS 1,608,410 A * 11/1926 Massacese ..... A47C 17/32 5/21
2,095,997 A * 10/1937 Martin ..... A47C 17/32 5/18.1
2,162,146 A * 6/1939 Wesley ..... A47C 17/32 5/21
4,776,047 A 10/1988 DiMatteo
5,231,710 A * 8/1993 Markel ..... A47C 17/13 297/107
5,937,456 A 8/1999 Norris
6,643,873 B2 11/2003 Heimbrock et al.
8,646,132 B2 2/2014 Nguyen
9,839,565 B1 * 12/2017 Harris ..... A61G 5/1059
2013/0298331 A1 * 11/2013 Bossingham ..... A61G 7/002 5/613
2013/0340167 A1 * 12/2013 Karwal ..... A61G 7/005 5/611
2015/0128347 A1 * 5/2015 Hutchison ..... A61G 7/015 5/616
2015/0135433 A1 5/2015 Jei
2017/0027786 A1 * 2/2017 Williams ..... A61G 7/0507

FOREIGN PATENT DOCUMENTS

FR 2564305 A 11/1985

* cited by examiner

*Primary Examiner* — Nicholas F Polito
(74) *Attorney, Agent, or Firm* — Richard C. Litman; Nath, Goldberg & Meyer

(57) ABSTRACT

The bed with retractable side extension has a retractable shelf positioned below the mattress, the shelf being extendable from a side of the bed. The shelf has a face plate and a railing mounted on the face plate that moves outward with the shelf when the shelf is extended. A height-adjustable platform is mounted on the shelf. When the shelf is fully extended, the platform may be raised so that a top surface of the platform is level with the bed's mattress and an inner edge of the platform is adjacent the mattress. The platform is held in place by an adjustable support, which may releasably lock the platform in the raised position and can be unlocked to lower the platform back onto the shelf.

7 Claims, 8 Drawing Sheets

BED WITH RETRACTABLE SIDE EXTENSION

BACKGROUND

1. Field

The disclosure of the present patent application relates to hospital beds, and particularly to a bed with retractable side extension for supporting a patient while the bed is being cleaned.

2. Description of the Related Art

In many inpatient or elderly care situations, especially when the patient has limited or no mobility, it is important to reduce potentially injuring forces to the body. However, it is also essential to keep the patient's environment clean to prevent any viral or bacterial infections. This is especially the case for the patient's bed, which should be cleaned on a daily basis.

Daily cleaning of the bed is difficult when the patient has no mobility or limited mobility, since the patient will need to be moved by others. Additionally, the process of moving the patient may cause injuries. The potential for injuries and discomfort increases with the distance the patient has to be moved. Accordingly, it is desired to have an apparatus that minimizes the distance the patient needs to be moved when cleaning the bed.

Thus, a bed with retractable side extension solving the aforementioned problems is desired.

SUMMARY

The bed with retractable side extension has a shelf positioned below the mattress, the shelf being designed to extend outward from a side of the bed. A railing on the shelf side of the bed is attached to a face plate and moves outward with the shelf when the shelf is extended from the side of the bed. A platform that can be raised is mounted on the shelf. When the shelf is fully extended, the platform may be raised to a height where a top surface of the platform is level with the bed's mattress and an inner edge of the platform is adjacent the mattress. The platform is held in place by an adjustable support, which may lock the platform in the raised position and which can be unlocked to lower the platform on the shelf.

When the platform is raised and locked in place, a patient can be moved from the bed to the platform. The unoccupied mattress may then be cleaned by replacing the sheets or performing other sanitizing tasks. Once the mattress has been cleaned, the patient may be moved back onto the mattress, the platform can be lowered on the shelf, and the extension pushed back into the space below the bed with the rail on the face plate acting as the side rail for the bed.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
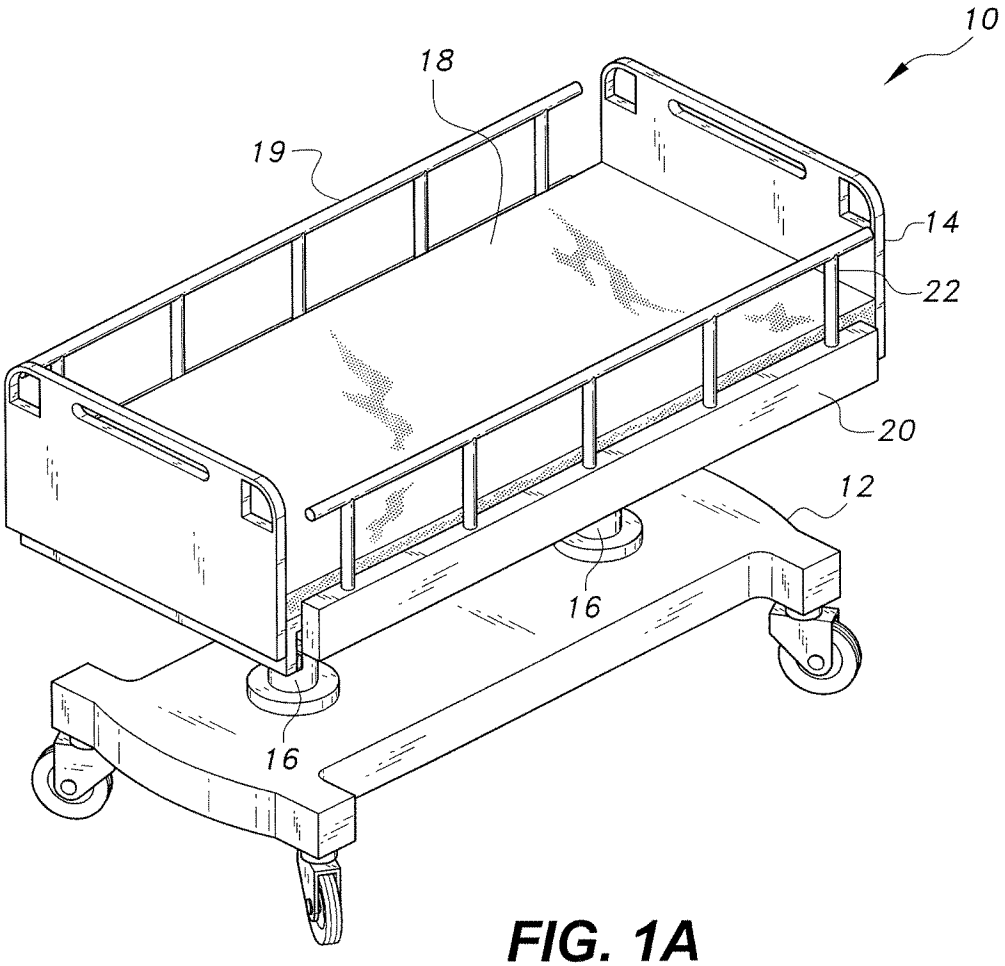
FIG. 1A is a perspective view of the bed with retractable side extension.
Figure 1B:
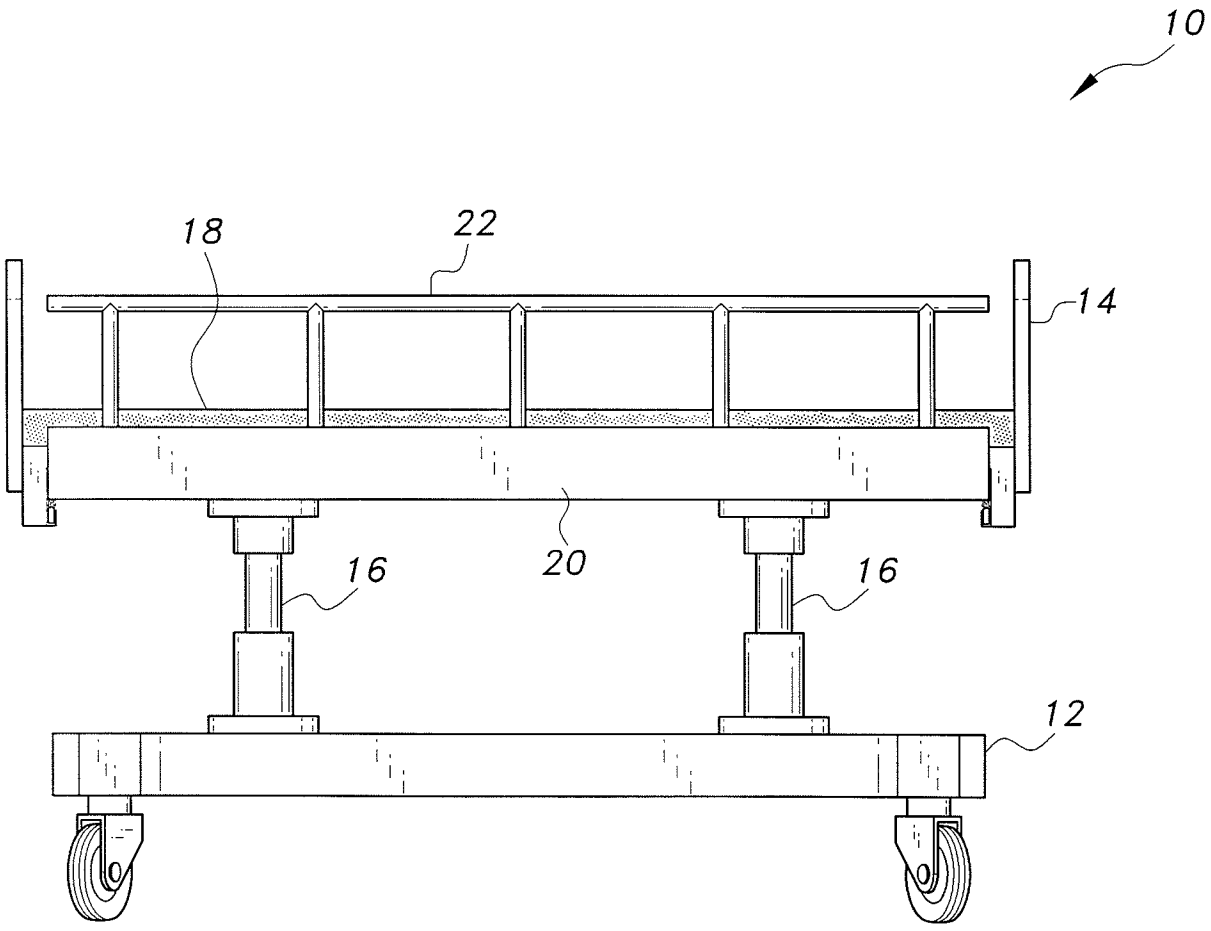
FIG. 1B is a side view of the bed of FIG. 1.

The bed with retractable side extension includes a shelf positioned below the mattress. The shelf is designed to extend outward from a side of the bed. A railing on the shelf side of the bed is attached to a face plate and moves outward with the shelf when the shelf is extended from the bed. A height-adjustable platform assembly is mounted on the shelf. When the shelf is fully extended to the side of the bed, the platform of the platform assembly may be raised to a height where a top surface of the platform is level with the bed's mattress and an inner edge of the platform is adjacent the mattress. The platform is held in place by an adjustable support, which may lock the platform in the raised position and can be unlocked to lower the platform on the shelf.

When the platform is raised and locked in place, a patient can be moved from the mattress to the platform. The unoccupied mattress may then be cleaned by replacing the sheets or performing other sanitizing tasks. Once the bed has been cleaned, the patient may be moved back onto the bed, the platform can be lowered back on the shelf, and the shelf may be pushed back into the space below the mattress, with the rail on the face plate acting as the side rail for the bed, the face plate concealing the side extension from view.

FIGS. 1A-3C show an embodiment of a bed with retractable side extension, designated generally as 10 in the drawings. The bed 10 may include a patient support 14 having a mattress 18, a base 12, and pillars 16 holding the patient support 14 above the base 12. A shelf 20 is mounted below the patient support 14 on a track 21. A height-adjustable platform 24 mounted on the shelf 20 may be raised to a height level with the mattress 18 (see FIG. 3A). The shelf 20 is movable from a retracted position, shown in FIG. 1, to an extended position, shown in FIG. 3A. In some embodiments, any releasable locking mechanism known in the art may be used to lock the shelf 20 in the retracted or the extended positions. A first railing 19 is connected to the patient support 14 and a second railing 22 is connected to a face plate 28 of the shelf 20. The face plate 28 conceals the shelf 20 from view when the shelf 20 is retracted beneath the patient support 14. Accordingly, the second railing 22 will move outward with the shelf 20 to accommodate moving a patient to the raised platform 24 while continuing to prevent the patient from rolling off the platform 24.

The shelf 20 and height-adjustable platform 24 may be used with any bed, including hospital or nursing home beds. The bed 10 may also have an adjustable height, for example, by adjusting the height of the pillars 16 holding the patient support 14. The patient support 14 of the bed 10 may also articulate to raise or lower the patient's head or feet. An example of a bed 10 that may be modified to include the shelf 20 and platform 24 is shown in U.S. Pat. No. 6,643,873, issued Nov. 11, 2003 to Heimbrock et al., which is hereby incorporated by reference in its entirety.

Figure 2:
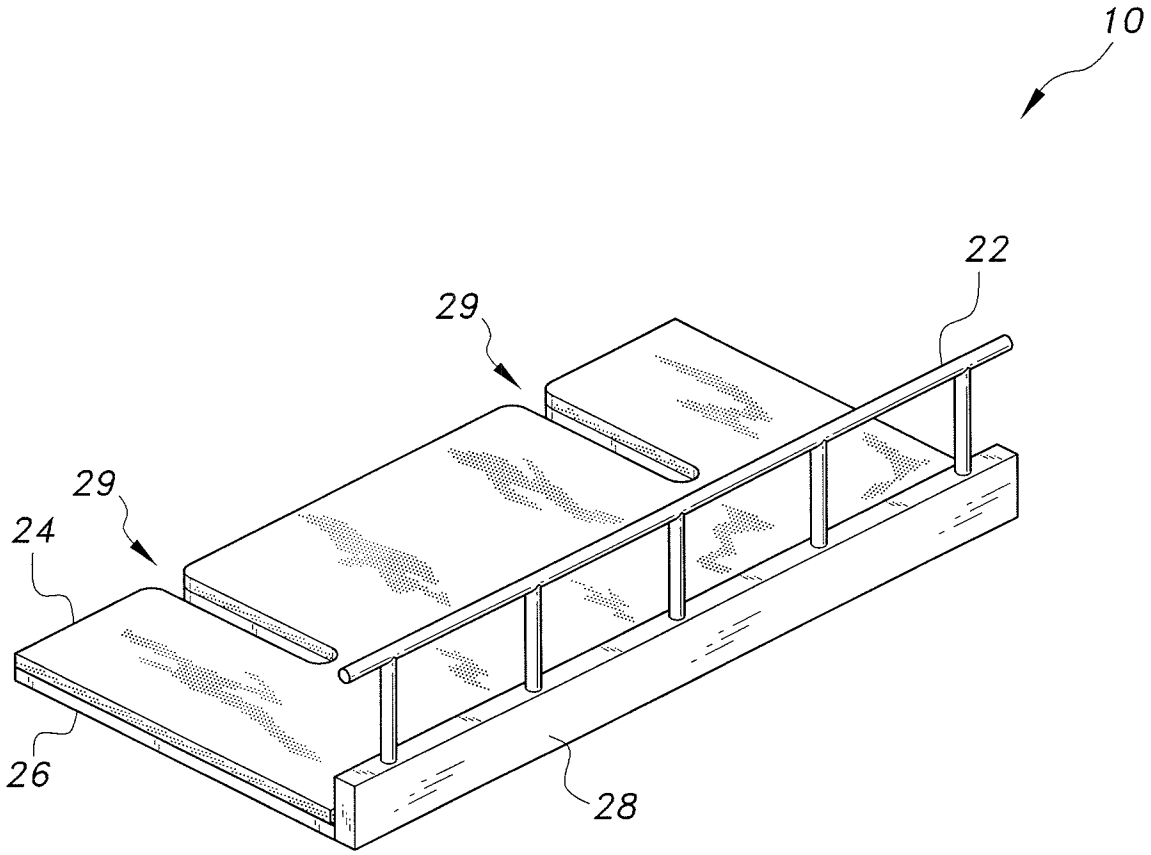
FIG. 2 is a perspective view of the retractable side extension of the bed of FIG. 1.

As shown in FIG. 2, the shelf 20 may include an outer side at the railing 22, an opposite inner side, a first end, and an opposite second end. The shelf 20 includes a base member 26, a face plate 28, and a railing 22 rigidly attached to the face plate 28. The height-adjustable platform 24 and an adjustable support 30 are mounted on the shelf 20. Two slots 29 may be defined in the inner side of the base member 26 and the attached platform 24 to prevent interaction with the pillars 16 of the bed 10 when the shelf 20 is retracted. Accordingly, when the shelf 20 is retracted, the pillars 16 will slide into the slots 29.

Figure 3A:
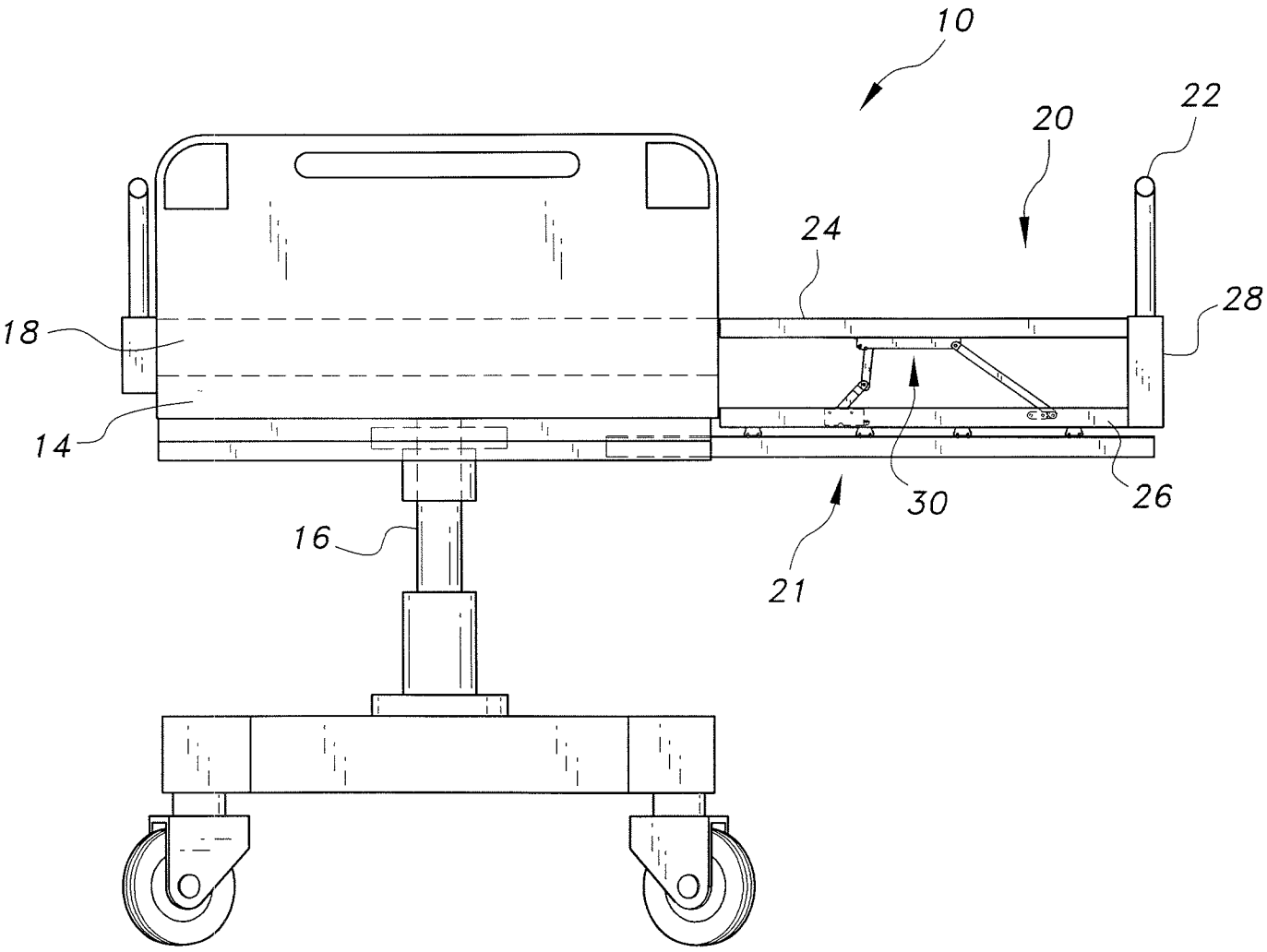
FIG. 3A is a front view of the bed of FIG. 1, shown with the side extension extended to the side of the bed and the platform in a raised position.
Figure 3B:
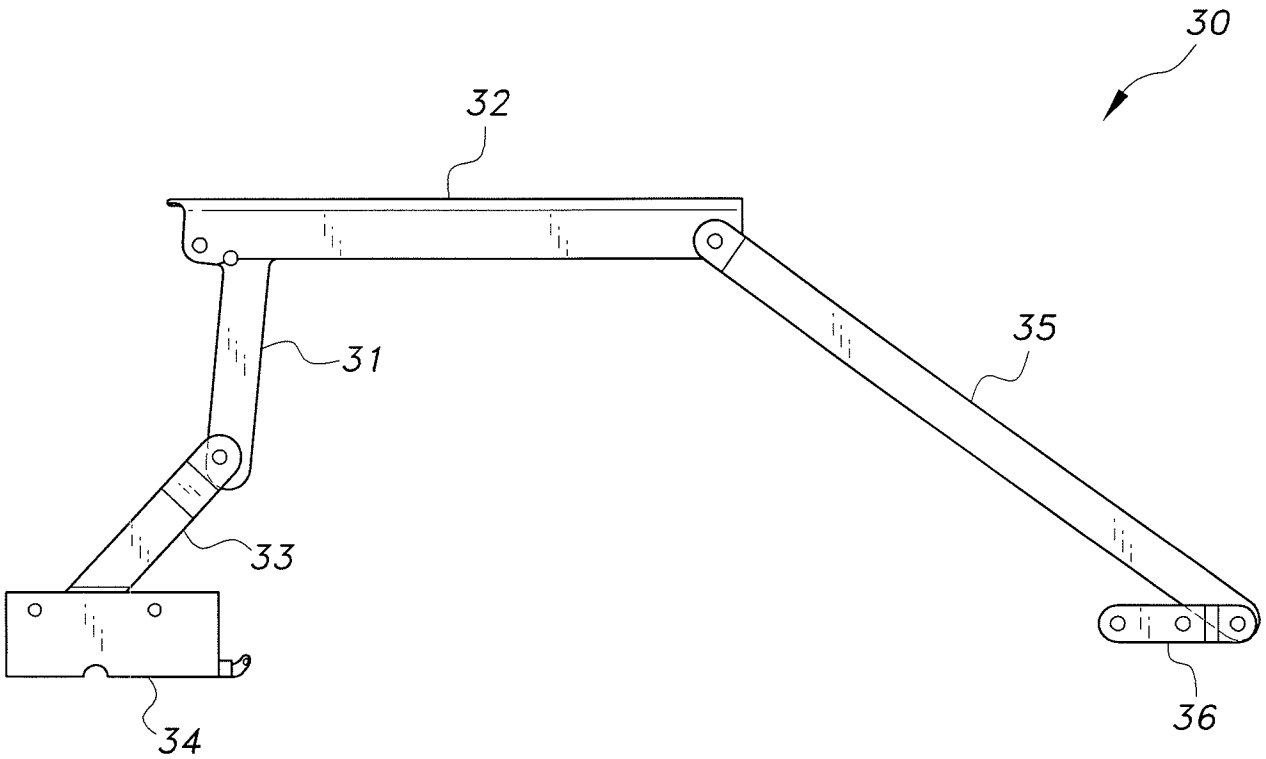
FIG. 3B is an end view of a first embodiment of the adjustable support shown supporting the platform in FIG. 3A, the adjustable support being shown in a raised position.
Figure 3C:
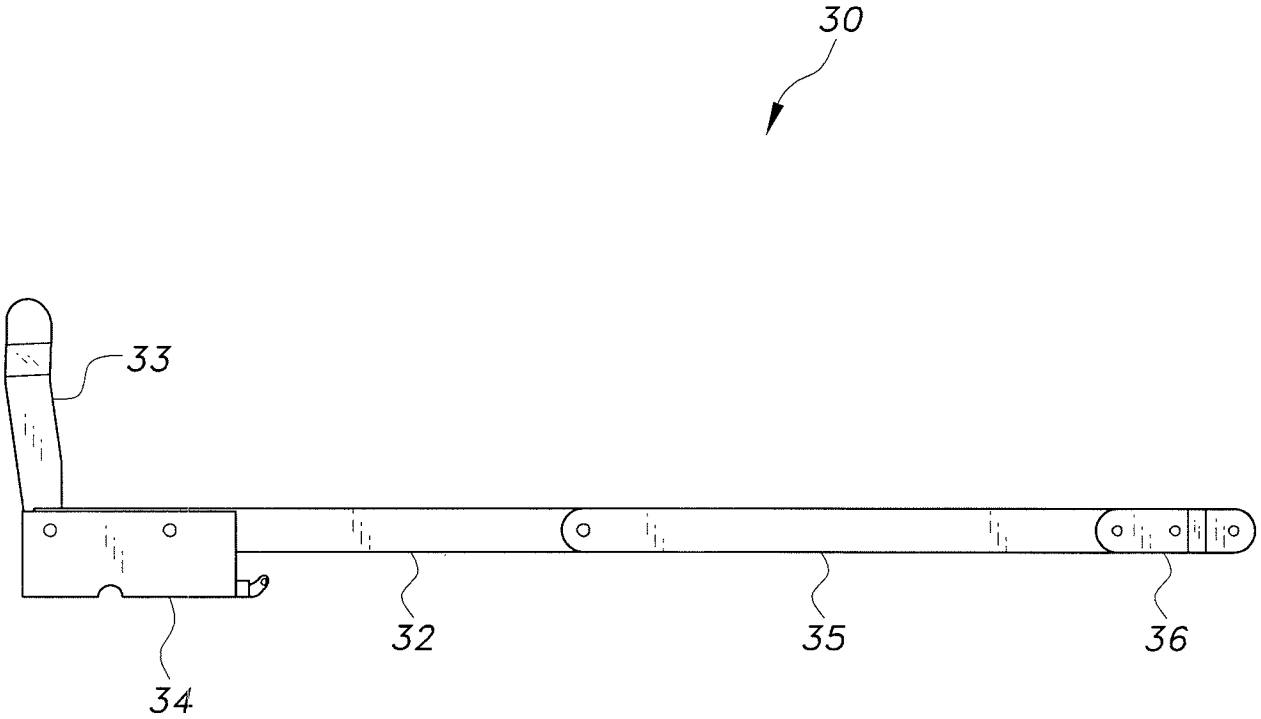
FIG. 3C is an end view of the adjustable support of FIG. 3B, shown in a lowered position.

FIGS. 3A-3C show a first embodiment of an adjustable support 30 for raising the platform 24 level with the mattress 18. The adjustable support 30 may lock at a raised position and at a lowered position. To prepare the platform 24 for raising, the shelf 20 is pulled out to an end of the tracks 21. In some embodiments, the shelf 20 may be releasably locked in the fully extended position. Once the shelf 20 is in the fully extended position, the platform 24 and adjustable support 30 may simultaneously be raised to the position shown in FIG. 3A. An adjustable support 30 may be provided on at least both ends of the platform 24, or the adjustable support 30 may be elongate, extending for a substantial portion of the length of the platform 24, with parallel linkages at opposite ends of the support 30. In some embodiments, additional supports may be provided on the face plate 28 of the shelf 20. Once the platform 24 is in a raised position, the additional supports may be extended out from the face plate 28 to further support the outer side of the platform 24.

FIG. 3B shows a first embodiment of the adjustable support 30 in the raised position. The adjustable support 30 includes an upper support plate or bracket 32 that may be attached to a lower side of the platform 24. A bed side or inner side of the upper support plate 32 is attached to an inner lower bracket 34 by a first inner link 31 and a second inner link 33. The railing side or outer side of the upper support plate 32 is attached to an outer lower bracket 36 by an outer link 35. Both the inner 34 and outer 36 lower brackets may be attached to the base member 26 of the shelf 20. The first 31 and/or second 33 inner links may include a stop that prevents the second inner link 33 from rotating any further clockwise relative to the first inner link 31 than shown in FIG. 3B. Preventing further rotation of the second inner link 33 relative to the first inner link 31 will lock the platform 24 in a raised position. One adjustable support 30 may be provided on each end of the platform 24 and additional supports may be added therebetween, or the adjustable support 30 may be elongated, as described above.

The platform 24 may be moved from the raised position to the lowered position by lifting the side of the platform 24 closest to the railing 22. Pulling up and out on the outer side of the platform 24 will pull the first 31 and second 33 inner links to a parallel orientation. When the platform 24 is then pushed down and back onto the shelf 20, the second inner link 33 will rotate counter clockwise (relative to the point of view shown in FIGS. 3B-3C) and the first inner link 31 will rotate clockwise, resulting in the orientation shown in FIG. 3C, which results in the platform 24 lying flat on the shelf 20, as shown in FIG. 2. To raise the platform 24, the outer side is first pulled up and out, which pulls the first 31 and second 33 inner links to a parallel orientation. Once the first 31 and second 33 inner links are in the parallel orientation, lowering the outer side of the platform 24 will result in the first 31 and second 33 inner links locking in the position shown in FIG. 3B.

Figure 4A:
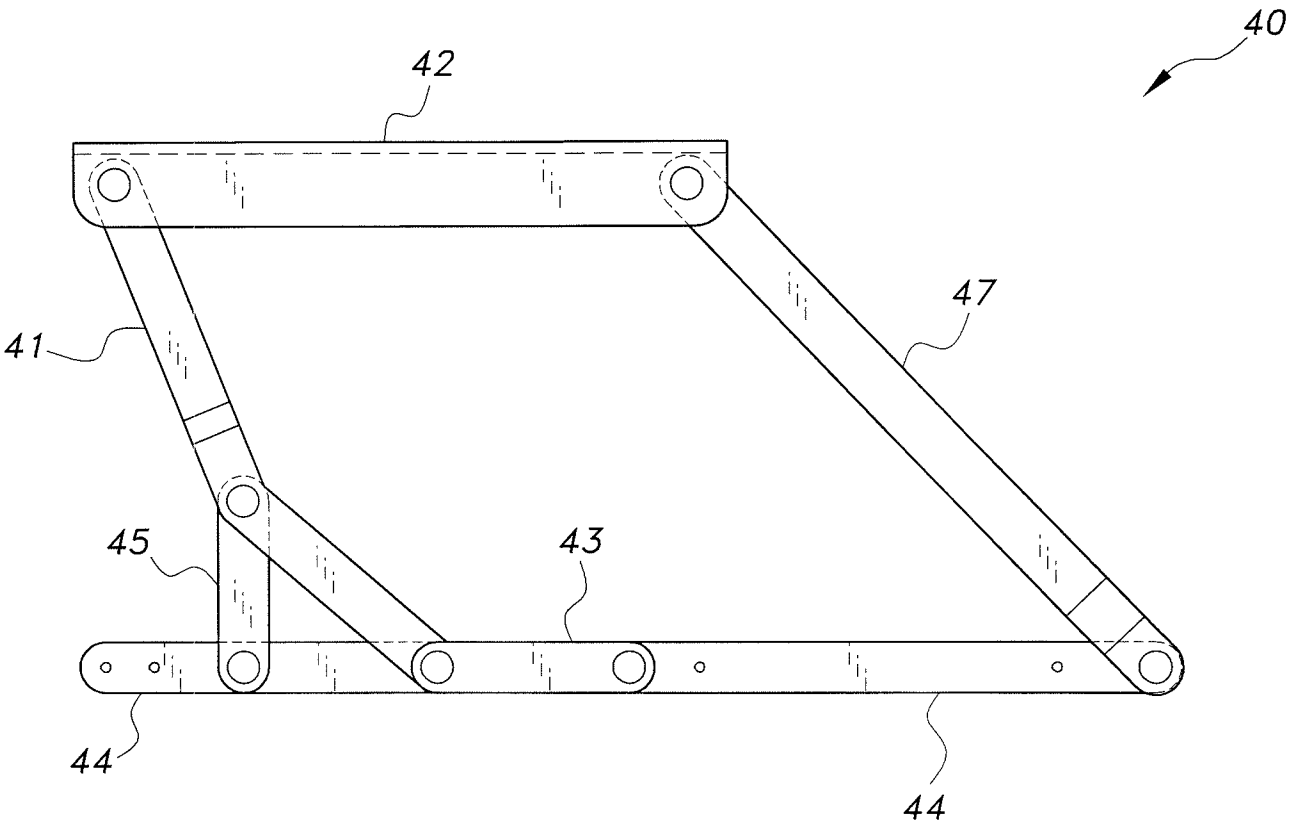
FIG. 4A is an end view of a second embodiment of an adjustable support, shown in a raised position.
Figure 4B:
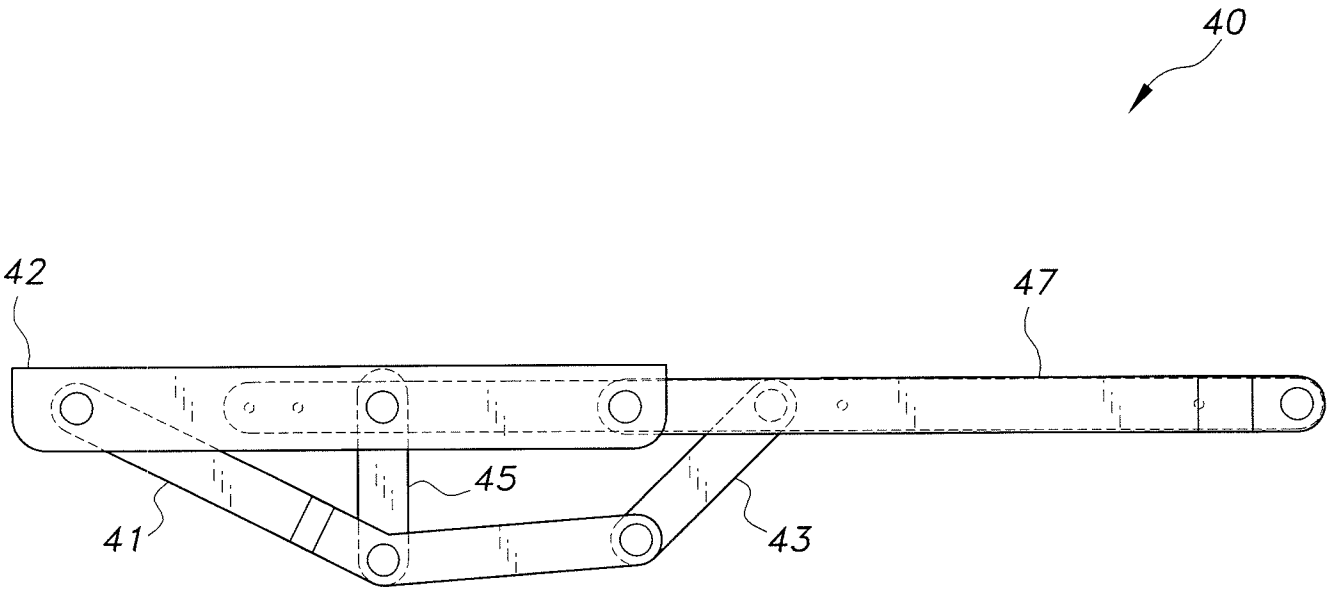
FIG. 4B is an end view of the adjustable support of FIG. 4A, shown in a lowered position.

FIGS. 4A and 4B show a second embodiment of the adjustable support 40 for raising the platform 24 level with the mattress 18. The adjustable support 40 of FIGS. 4A and 4B may be attached to the shelf 20 and platform 24 in the same manner as the adjustable support 30 of FIGS. 3A-3C. The adjustable support 40 includes an upper support plate or bracket 42 and a lower bracket 44, each having an inner side and an outer side. The upper support plate 42 may be attached to the bottom of the platform 24, and the lower bracket 44 may be attached to the shelf 20. The inner side of the upper support plate 42 is connected to a first end of an angled link 41. A central portion of the angled link 41 is connected to an inner link 45, and a second end of the angled link 41 is connected to a middle link 43. The inner link 45 is connected to the inner side of the lower bracket 44. The outer side of the upper support plate 42 is connected to the outer side of the lower bracket 44 by an outer link 47. The middle link 43 is connected to the lower bracket 44 at a point between the inner 45 and outer 47 links.

Similar to the adjustable support 30 of FIGS. 3A-C, the adjustable support 40 may be lowered by pulling the outer side of the platform 24 up and out. This will initiate movement of the inner link 45 in a clockwise direction (based on the point of view seen in FIGS. 4A and 4B). The inner link 45 will then rotate clockwise to six o'clock, and the other links 41, 43, 47 will rotate downward while the platform 24 is lowered, resulting in the lowered configuration shown in FIG. 4B. Raising the platform 24 may be accomplished by lifting and pulling out the outer side of the platform 24, which will cause the inner link 45 to rotate counterclockwise to twelve o'clock, and the other links 41, 43, 47 to rotate upwards to the raised position shown in FIG. 4A.

It is to be understood that the bed with retractable side extension is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A bed with retractable side extension, comprising:

a patient support having a front, a back, a first side and an opposite second side, the patient support including a mattress, the mattress having an upper surface;

a base positioned below the patient support;

at least one pillar holding the patient support above the base;

a shelf positioned between the patient support and the base, the shelf being connected to the patient support by a track, the track providing a lateral range of motion to the shelf from a closed position below the patient support to an open position extended out from the first side of the patient support in a cantilevered fashion;

a platform mounted on the shelf, the platform having an upper surface; the platform being height-adjustable to a raised position so that the upper surface of the platform is level with an upper surface of the mattress and an edge of the platform is adjacent the mattress, the platform being adjustable to a lowered position on the shelf, the platform being releasably lockable in the raised and lowered positions, respectively; and at least one adjustable support, the at least one adjustable support including an upper support plate connected to the platform, at least one lower bracket connected to the shelf, and at least one linkage connecting the upper support plate and the at least one lower bracket, the at least one adjustable support being releasably lockable in a raised position to support the platform in the raised position.

2. The bed with retractable side extension according to claim 1, further comprising a face plate attached to the shelf and a railing mounted on the face plate, the railing extending up past the top surface of the mattress, the face plate concealing the shelf when the shelf is retracted below the patient support.

3. The bed with retractable side extension according to claim 2, wherein:

the at least one lower bracket includes an outer bracket and an inner bracket, the outer bracket being closer to the railing than the inner bracket; and the at least one linkage includes an elongated outer link connected at one end to the outer bracket and at the opposite end to an outer end of the upper support plate of said adjustable support, and two inner links connected in series, one of the inner links being connected to the inner bracket and the other link being connected to an inner end of the upper support plate of said adjustable support.

4. The bed with retractable side extension according to claim 2, wherein the at least one linkage includes an outer link connected to an outer end of the lower bracket and to an outer end of the upper support plate of said adjustable support, an inner link connected to an inner end of the lower bracket, a middle link connected to the lower bracket at a point between the first and second links, and one angled link connected to an inner end of the upper support plate, the inner link, and the middle link.

5. The bed with a retractable side extension according to claim 1, wherein the shelf and the platform each define at least one slot, the at least one slot extending around the at least one pillar when the shelf is retracted below the patient support.

6. The bed with retractable side extension according to claim 1, wherein the at least one pillar comprises two pillars, the shelf and the platform each defining two slots, each of the slots extending around a respective pillar when the shelf is retracted below the patient support.

7. The bed with a retractable side extension according to claim 1, wherein the shelf is selectively lockable in an extended position and in a retracted position.

* * * * *